US006691603B2

(12) United States Patent
Linerode et al.

(10) Patent No.: US 6,691,603 B2
(45) Date of Patent: Feb. 17, 2004

(54) IMPLEMENT PRESSURE CONTROL FOR HYDRAULIC CIRCUIT

(75) Inventors: James D. Linerode, Naperville, IL (US); Aleksandar M. Egelja, Naperville, IL (US)

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 110 days.

(21) Appl. No.: 10/029,266

(22) Filed: Dec. 28, 2001

(65) Prior Publication Data

US 2003/0121408 A1 Jul. 3, 2003

(51) Int. Cl.[7] ..... F15B 11/10
(52) U.S. Cl. ..... 91/433; 91/454
(58) Field of Search ..... 91/433, 454

(56) References Cited

U.S. PATENT DOCUMENTS

| | | | | |
|---|---|---|---|---|
| 4,369,625 A | | 1/1983 | Izumi et al. | 60/327 |
| 5,003,776 A | | 4/1991 | Kanai et al. | 60/434 |
| 5,295,795 A | | 3/1994 | Yasuda et al. | 417/213 |
| 5,540,049 A | | 7/1996 | Lunzman | 60/327 |
| 5,701,793 A | | 12/1997 | Gardner et al. | 91/361 |
| 5,737,993 A | | 4/1998 | Cobo et al. | 91/361 |
| 5,897,287 A | | 4/1999 | Berger et al. | 414/699 |
| 5,899,008 A | | 5/1999 | Cobo et al. | 37/348 |
| 5,941,155 A | | 8/1999 | Arai et al. | 91/38 |
| 5,953,977 A | | 9/1999 | Krishna et al. | 91/361 |
| 6,467,264 B1 | * | 10/2002 | Stephenson et al. | 91/454 |

* cited by examiner

*Primary Examiner*—Edward K. Look
*Assistant Examiner*—Michael Leslie
(74) *Attorney, Agent, or Firm*—Finnegan, Henderson, Farabow, Garrett & Dunner

(57) ABSTRACT

A method for controlling a hydraulic system may include receiving an input command from an input device, generating a desired working pressure value relating to a working chamber of an actuator based on the input command, and generating a desired pressure value relating to a non-working chamber of the actuator based on the input command. The method may also include operating a valve assembly to control a fluid flow condition of the working chamber and to control fluid flow from the non-working chamber.

28 Claims, 2 Drawing Sheets

IMPLEMENT PRESSURE CONTROL FOR HYDRAULIC CIRCUIT

TECHNICAL FIELD

The invention relates generally to a fluid control system and, more particularly, to a control algorithm that provides pressure control of an implement for a hydraulic circuit.

BACKGROUND

Conventional hydraulic systems, for example, those implemented in large excavators, typically include an open center hydraulic system for implements because a closed center system may not provide the operator with as much of a "feel" for how much of a load is resisting movement of an implement, as an open center system does. This loss of "feel" results from the closed center system having pressure compensated flow control that keeps the flow to the working cylinder substantially constant. However, the open center system is generally less efficient than a closed center system because some or all fluid flow in the open center system usually gets to tank without performing any work, depending on the flow request from the operator.

A hydraulic circuit may include a pressure sensor or an implement position sensor associated with an actuator, for example, a cylinder. The sensor provides signals to an electronic controller so that fluid flow to the actuator is controlled with the control algorithm that uses sensor feedback signals. One typical hydraulic circuit, as shown in U.S. Pat. No. 5,737,993, includes cylinder pressure sensors associated with hydraulic cylinders. The sensors deliver cylinder pressure signals to a controller, which uses the signals to generate cylinder force signals, for example, current commands, usable by a valve assembly to provide hydraulic fluid flow to the cylinders. The circuit does not control fluid flow from the hydraulic cylinders to the tank.

A fluid control system for effectively and efficiently controlling pressures of working and non-working chambers of an actuator is desired. It is also desired to provide an open center feel to a closed center hydraulic system for operating an implement. The present invention is directed to solving one or more of the problems set forth above.

SUMMARY OF THE INVENTION

According to one aspect of the invention, a method is provided for controlling a hydraulic system. The method may include receiving an input command from an input device, generating a desired working pressure value relating to a working chamber of an actuator based on the input command, and generating a desired pressure value relating to a non-working chamber of the actuator based on the input command. The method may also include operating a valve assembly to control a fluid flow condition of the working chamber and to control fluid flow from the non-working chamber.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention. In the drawings.

DETAILED DESCRIPTION

Reference will now be made in detail to embodiments of the invention, examples of which are illustrated in the accompanying drawings. Wherever possible, the same reference numbers will be used throughout the drawings to refer to the same or like parts.

Figure 1:
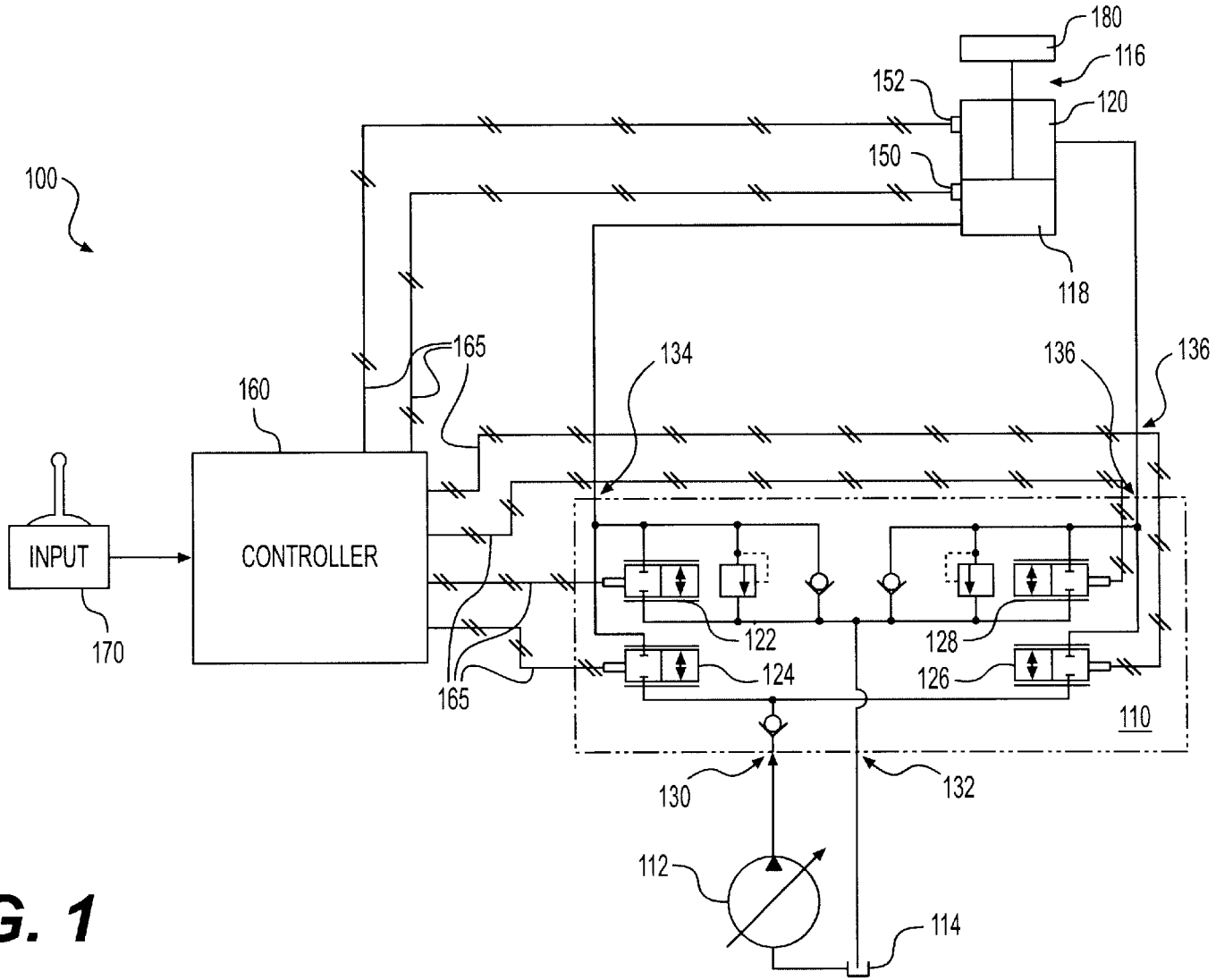
FIG. 1 is a schematic illustration of a hydraulic circuit in accordance with one exemplary embodiment of the present invention.

Referring to FIG. 1, a fluid control system, for example, hydraulic circuit 100, includes a valve assembly, for example, an independent metering valve arrangement 110, a pump 112, a tank 114, and an actuator 116, for example, a hydraulic cylinder such as an implement cylinder. The actuator 116 may have a head end chamber 118 and a rod end chamber 120. The pump 112 may be, for example, a variable-displacement, high pressure pump.

The independent metering valve arrangement 110 includes a plurality of independently-operated, electronically-controlled metering valves 122, 124, 126, 128. The metering valves 122, 124, 126, 128 control fluid flow between the pump 112, the tank 114, and the hydraulic actuator 116. Thus, the independent metering valve arrangement 110 may control fluid communication between at least one of the pump 112, the tank 114, and the head end and rod end chambers 118, 120 of the hydraulic actuator 116. The metering valves may be spool valves, poppet valves, or any other conventional type of metering valve that would be appropriate. The metering valves are referred to individually as a cylinder-to-tank head end (CTHE) metering valve 122, a pump-to-cylinder head end (PCHE) metering valve 124, a pump-to-cylinder rod end (PCRE) metering valve 126, and a cylinder-to-tank rod end (CTRE) metering valve 128. The independent metering valve arrangement 110 also includes an input port 130, an output port 132, a head end control port 134, and a rod end control port 136.

The hydraulic control system 100 also includes a head end pressure sensor 150, a rod end pressure sensor 152, a controller 160, and an operator input device 170. The head and rod end pressure sensors 150, 152 are configured to communicate with the controller 160. One skilled in the art will understand that any number of available pressure sensors may be utilized and will further understand the requisite location of such sensors. The input device 170 also communicates with the controller 160 and allows an operator to control the hydraulic circuit 100. For example, the input device 170 allows the operator to lift a load 180, extend a load 180, push a load 180, pull a load 180, or the like. Alternatively, the input device 170 may represent a source of input commands from, for example, a computer used to automatically control the actuator 116 without an operator.

As shown in FIG. 1, the controller 160 communicates electronically with the input device 170, the metering valves 122, 124, 126, 128, and the pressure sensors 150, 152. The controller 160 may receive information from the input device 170, for example, a lift, extend, and/or push command, as well as from the pressure sensors 150, 152. Based on the commands from the input device 170 and the pressure sensors 150, 152, the controller may determine a desired operation for the hydraulic circuit 100 and an appropriate set of outputs 165 to the metering valves 122, 124, 126, 128. In one embodiment, the outputs 165 may represent current to each of the metering valves 122, 124, 126, 128.

Figure 2:
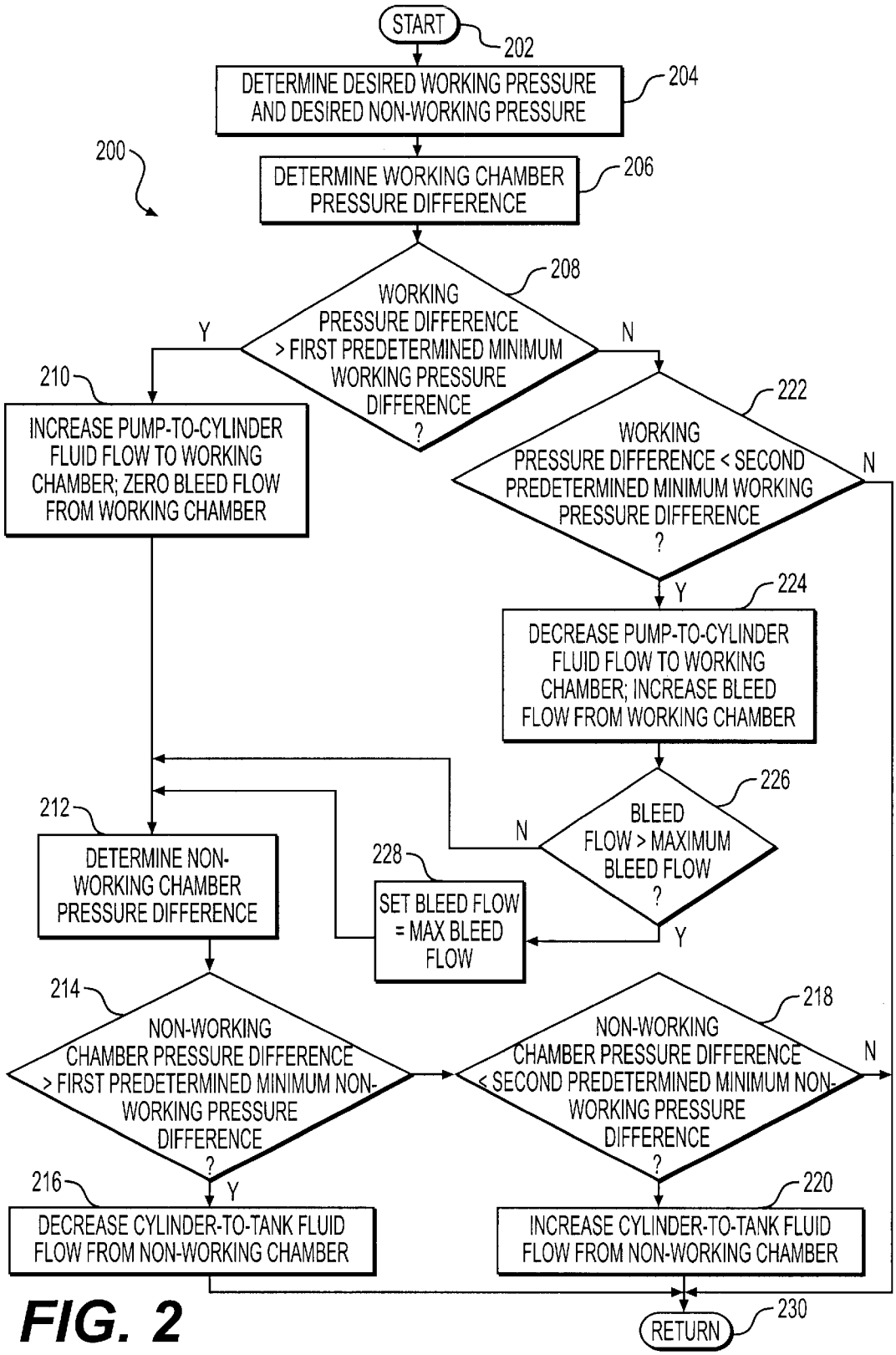
FIG. 2 is a block diagram in accordance with one exemplary embodiment of the present invention.

FIG. 2 is an exemplary operation 200 of the controller 160 in accordance with a first exemplary embodiment of the hydraulic circuit 100. It should be appreciated that numerical values utilized by this exemplary operation 200 may differ depending on the machinery employing an algorithm according to the invention.

Referring to FIG. 2, control commences with step 202 when the controller 160 receives a command from the input device 170. In step 204, the controller 160 determines desired pressures for a working chamber and for a non-working chamber of the actuator 116 based on the input command. The desired pressures may be determined, for example, by extrapolation from graphs, a mathematical algorithm, or the like. For example, a rearward pull on the input device 170, for example, an operating lever, may represent a desire to lift a load 180. The position of the input device 170 corresponds to a desired pressure for the working chamber and a desired pressure for the non-working chamber associated with lifting the load 180. Alternatively, the position of the input device 170 may correspond to a position of an implement or a velocity of the implement. When lifting a load, the head end chamber 118 would be the working chamber. The opposite will be true for a forward push on the input device 170. Further, it should be appreciated that the effect of the directional movement of the input device 170 may be reversed.

Control then continues to step 206 where the controller 160 determines the pressure difference at the working chamber. For example, when the head end chamber 118 is the working chamber, the pressure difference may be determined by subtracting the implement working pressure sensed by the head end pressure sensor 150 from the desired pressure, which is determined by the position of the input device 170. When the rod end chamber 120 is the working chamber, the implement working pressure is sensed by the rod end pressure sensor 152.

Then, in step 208, the controller 160 determines whether the working chamber pressure difference is greater than a first predetermined minimum working pressure difference. The true value, for example, positive or negative, of the pressure difference is used for further computations. If the pressure difference is greater than the first predetermined minimum pressure difference, control proceeds to step 210. Otherwise, control skips to step 222.

In step 210, the controller 160 increases the fluid flow to the working chamber. The fluid flow to the working chamber may be controlled by operating the pump-to-cylinder metering valve 124, 126 associated with the working chamber. For example, if the head end chamber 118 is the working chamber, the PCHE metering valve 124 is controllably opened to increase the fluid flow to the head end chamber 118. The PCRE metering valve 126 is controllably opened when the rod and chamber 120 is the working chamber. The amount that the pump-to-cylinder metering valve 124, 126 associated with the working chamber is opened may be determined, for example, by a predetermined algorithm or look-up table. Gradual ramping of the fluid flow to the working chamber may provide a more controlled and/or smoother movement of the load 180. The ramping may be a linear or non-linear function.

Also in step 210, the controller 160 may zero the bleed from the working chamber of the actuator 116 by closing the corresponding cylinder-to-tank metering valve 122, 128. The CTHE 122 is closed when the head end chamber 118 is the working chamber, and the CTRE 128 is closed when the rod end chamber 120 is the working chamber. Zeroing the bleed flow from the working chamber of the actuator 116 may facilitate a quicker pressure buildup of fluid pressure at the working chamber. It should be appreciated that zeroing the bleed flow may include completely eliminating the bleed flow instantaneously or ramping down the bleed flow toward zero in accordance with a predetermined algorithm or look-up table. Control continues to step 212.

Then, in step 212, the controller 160 determines the pressure difference at the non-working chamber. For example, when the head end chamber 118 is the working chamber, the rod end chamber 120 is the non-working chamber. In such a situation, the pressure difference may be determined by subtracting the pressure sensed by the rod end pressure sensor 152 from the desired non-working pressure, which is determined by the position of the input device 170. The opposite will occur when the rod end chamber 120 is the working chamber. Control continues to step 214

Then, in step 214, the controller 160 determines whether the pressure difference at the non-working chamber is greater than a first predetermined minimum non-working pressure difference. If the pressure difference is greater than the first predetermined minimum non-working pressure difference, control proceeds to step 216. Otherwise, control skips to step 218.

In step 216, the controller 160 decreases the cylinder-to-tank fluid flow from the non-working chamber. For example, if the head end chamber 118 is the working chamber and the rod end chamber 120 is the non-working chamber, the CTRE metering valve 128 is controllably closed to decrease the fluid flow to the tank 114 and raise the pressure in the non-working chamber. The opposite occurs when the rod end chamber 120 is the working chamber and the head end chamber 118 is the non-working chamber. Control then continues to step 230, where control is returned to step 202. At this moment, the controller 160 updates all commands to the valves 122, 124, 126, 128.

In step 218, the controller 160 determines whether the pressure difference at the non-working chamber is less than the second predetermined minimum non-working pressure difference. If the pressure difference is less than the second predetermined minimum non-working pressure difference, control proceeds to step 220. Otherwise, control skips to step 230, where control is returned to step 202.

In step 220, the controller 160 increases the cylinder-to-tank fluid flow from the non-working chamber. For example, if the head end chamber 118 is the working chamber and the rod end chamber 120 is the non-working chamber, the CTRE metering valve 128 is controllably opened to increase the fluid flow to the tank 114 and lower the pressure in the non-working chamber. The opposite occurs when the rod end chamber 120 is the working chamber and the head end chamber 118 is the non-working chamber. Control then continues to step 230, where control is returned to step 202.

In step 222, after the working pressure difference has been determined not to be greater than the first predetermined working pressure difference in step 208, the controller 160 determines whether the working pressure difference is less than the second predetermined minimum working pressure difference. If the pressure difference is less than the second predetermined minimum working pressure difference, control proceeds to step 224. Otherwise, control skips to step 230, where control is returned to step 202.

In step 224, the controller 160 decreases the fluid flow to the working chamber. The fluid flow to the working chamber may be controlled by operating the pump-to-cylinder metering valve 124, 126 associated with the working chamber. For example, if the head end chamber 118 is the working chamber, the PCHE metering valve 124 is controllably closed to decrease the fluid flow to the head end chamber 118. The PCRE metering valve 126 is controllably closed when the rod and chamber 120 is the working chamber. The amount that the pump-to-cylinder metering valve 124, 126 associated with the working chamber is closed may be determined, for example, by a predetermined algorithm or a look-up table. Gradual ramping of the fluid flow to the working chamber may provide a more controlled and/or smoother movement of the load 180. The ramping may be a linear or non-linear function.

Also in step 224, the controller 160 may increase the bleed from the working chamber of the actuator 116 to the tank 114 by opening the corresponding cylinder-to-tank metering valve 122, 128. The CTHE 122 is opened when the head end 118 is the working chamber, and the CTRE 128 is opened when the rod end 120 is the working chamber. Increasing the bleed flow from the working chamber of the actuator 116 may facilitate a quicker pressure drop in fluid pressure at the working chamber. Control continues to step 226.

Then, in step 226, the controller 160 determines if the amount of bleed flow is greater than a predetermined maximum bleed flow. The maximum bleed flow may be any predetermined amount and may differ depending on the machinery employing an algorithm according to the invention. If the bleed flow is greater than the predetermined maximum, control continues to step 228. Otherwise, control jumps to step 212.

In step 228, the controller 160 limits the bleed flow to the predetermined maximum bleed flow. Control then continues to step 212.

When control goes to step 212 from either step 226 or 228, the controller 160 continues with the determinations, comparisons, and actions of steps 212, 214, 216, 218, and/or 220, as described above.

Industrial Applicability

In use, the metering valves 122, 128 control cylinder-to-tank fluid flow while the metering valves 124, 126 control pump-to-cylinder fluid flow. Conventional extension of the actuator 116 may be achieved, for example, by selective, operator-controlled actuation of the metering valves 124, 128 and retraction of the actuator 116 may be achieved, for example, by simultaneous operator controlled actuation of the metering valves 122, 126.

Referring to FIG. 1, when the input device 170 is moved by an operator, an input may be provided to initiate the exemplary control operation shown in FIG. 2. The input may include a desired working pressure at the working chamber and a desired pressure at the non-working chamber based on, for example, a lever position of the input device 170.

For example, an operator may initially move the input device 170 to a position corresponding to extension of the actuator 116 to lift a load 180, for example, an implement. Accordingly, the desired working pressure to be applied to a working chamber and the desired pressure of the non-working chamber may be determined from an input command associated with the input device 170.

As the exemplary operation 200 proceeds, the desired working pressure is compared to the pressure at the working chamber associated with extension of the load 180, for example, the head end chamber 118, as sensed by the head end pressure sensor 150. When initiating operation of the actuator 116, the pressure difference may be determined by subtracting the implement working pressure from the desired pressure, thus resulting in a relatively large positive value, will likely be greater than the first predetermined working pressure difference, for example, 50 KPa. As described above. Therefore, the controller 160 may operate the PCHE metering valve 124 to increase the fluid flow from the pump 112 to the head end chamber 118 and zero the bleed flow from the head end chamber 118 to the tank 114, thereby increasing the pressure at the head end chamber 118.

Similarly, if a pressure difference between the desired pressure at the non-working chamber associated with extension of the actuator 116, for example, the rod end chamber 120, and the pressure sensed by the rod end pressure sensor 152 is greater than a first predetermined non-working pressure difference, for example, 50 KPa, the controller 160 may operate the CTRE metering valve 128 to decrease fluid flow to the tank 114, thereby raising pressure at the rod end chamber 120. Alternatively, if the pressure difference is not greater than the second predetermined non-working pressure difference, the controller 160 may operate the CTRE metering valve 128 to increase fluid flow to the tank 114, thereby lowering the pressure at the rod end chamber 120.

When the actuator 116 is operating an implement and the implement meets resistance, for example, from a rock formation in the soil, a pipe, and the like, the pressure in the working chamber, for example, the head end chamber 118 builds up. The fluid pressure at the head end chamber 118, as sensed by the head end sensor 150, may continue to increase as it approaches the desired working pressure. Once the sensed pressure at the head end chamber 118 exceeds the desired pressure, the controller may operate the PCHE metering valve 124 to decrease the fluid flow to the head end chamber 118 from the pump 112, and the controller 160 may operate the CTHE metering valve 122 to increase the bleed flow from the head end chamber 118 to the tank 114. As a result, the pressure at the head end chamber 118 may be reduced to a pressure less than the desired working pressure. Maintaining the pressure at the head end chamber 118 below the desired working pressure may prevent the implement from ripping through unseen objects, for example, a buried pipe. On the other hand, if the operator can see the resisting object, for example, a rock formation, the operator can selectively move the input device 170 to increase the fluid pressure to the actuator.

Thus, the present invention provides pressure control for a hydraulic circuit, which may provide both flow control to the working and non-working chambers of a closed center system. The control algorithm may provide pressure control to both the working and non-working chambers of the hydraulic control system and/or provide an open center feel to a closed center hydraulic system.

As shown in FIG. 1, the operation of an exemplary embodiment of this invention may be implemented on a controller 160. The controller 160 may include a general purpose or special purpose computer, a programmed microprocessor or microcontroller and peripheral integrated circuit elements, an ASIC or other integrated circuit, a hardware electronic or logic circuit such as a discrete element circuit, a programmable logic device such as a PLD, PLA, FPGA or PAL, or the like. In general, any device on which a finite state machine capable of implementing the flowchart shown in FIG. 2 can be used to implement the controller functions of this invention.

It will be apparent to those skilled in the art that various modifications and variations can be made in the hydraulic control system and/or the control algorithm without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A fluid control system operative to control movement of at least one implement, the fluid control system comprising:

a pump;

a tank;

an actuator including a working chamber and a non-working chamber;

a valve assembly configured to control fluid communication between at least one of the working chamber and the tank, the working chamber and the pump, the non-working chamber and the tank, and the non-working chamber and the pump;

an input device operative to selectively control movement of the at least one implement; and a controller in communication with the valve assembly and the input device, the controller being configured to control a flow condition of the working chamber as a function of a working chamber pressure difference determined by comparing a pressure condition of the working chamber with a desired working pressure of the working chamber, and to control a flow condition from the non-working chamber to the tank as a function of a non-working chamber pressure difference determined by comparing a pressure condition of the non-working chamber with a desired pressure of the non-working chamber.

2. The system of claim 1, wherein the actuator includes a double-acting hydraulic cylinder configured to move a load.

3. The system of claim 1, wherein the controller is configured to control flow from the pump to the working chamber as a function of the pressure condition of the working chamber.

4. The system of claim 3, wherein the controller is configured to control flow from the working chamber to the tank as a function of the pressure condition of the working chamber.

5. The system of claim 1, wherein the input device includes an operating lever configured such that a position of the lever corresponds with the desired working pressure of the working chamber and the desired pressure of the non-working chamber.

6. The system of claim 1, wherein the controller is configured to determine the working chamber pressure difference and the non-working chamber pressure difference.

7. The system of claim 6, wherein, when the working chamber pressure difference is greater than a first predetermined working pressure difference, the controller is configured to operate the valve assembly to increase fluid flow from the pump to the working chamber.

8. The system of claim 7, wherein, when the working chamber pressure difference is greater than a first predetermined working pressure difference, the controller is configured to operate the valve assembly to zero a bleed flow from the working chamber to the tank.

9. The system of claim 7, wherein, when the non-working chamber pressure difference is greater than a first predetermined non-working pressure difference, the controller is configured to operate the valve assembly to decrease fluid flow from the non-working chamber to the tank.

10. The system of claim 7, wherein, when the non-working chamber pressure difference is less than a second non-working predetermined pressure difference, the controller is configured to operate the valve assembly to increase fluid flow from the non-working chamber to the tank.

11. The system of claim 6, wherein, when the working chamber pressure difference is less than a second predetermined working pressure difference, the controller is configured to operate the valve assembly to decrease fluid flow from the pump to the working chamber.

12. The system of claim 11, wherein, when the working chamber pressure difference is less than a second predetermined working pressure difference, the controller is configured to operate the valve assembly to increase a bleed flow from the working chamber to the tank, the increased bleed flow not exceeding a predetermined maximum bleed flow.

13. The system of claim 11, wherein, when the non-working chamber pressure difference is greater than a first predetermined non-working pressure difference, the controller is configured to operate the valve assembly to decrease fluid flow from the non-working chamber to the tank.

14. The system of claim 11, wherein, when the non-working chamber pressure difference is less than a second predetermined non-working pressure difference, the controller is configured to operate the valve assembly to increase fluid flow from the non-working chamber to the tank.

15. The system of claim 1, wherein the valve assembly includes a first valve configured to control fluid flow from the working chamber to the tank, a second valve configured to control fluid flow from the pump to the working chamber, a third valve configured to control fluid flow from the pump to the non-working chamber, and a fourth valve configured to control fluid flow from the non-working chamber to the tank, the first valve, the second valve, the third valve, and the fourth valve being individually controlled and operated.

16. A method for controlling a hydraulic system, comprising:

receiving an input command indicative of a desired movement of the hydraulic system;

generating a desired working pressure value relating to a working chamber of an actuator based on the input command;

generating a desired pressure value relating to a non-working chamber of the actuator based on the input command;

controlling a flow condition of the working chamber as a function of a pressure condition of the working chamber; and controlling a flow condition from the non-working chamber to the tank as a function of a pressure condition of the non-working chamber.

17. The method of claim 16, wherein said controlling a flow condition of the working chamber includes selectively and controllably operating independent valves to adjust fluid provided to the respective working chamber.

18. The method of claim 16, wherein said controlling a flow condition from the non-working chamber includes selectively and controllably operating independent valves to adjust fluid exiting the non-working chamber.

19. The method of claim 16, further including positioning an operating lever, the lever being configured such that a position of the lever corresponds with the desired working pressure value.

20. The method of claim 16, further including positioning an operating lever, the lever being configured such that a position of the lever corresponds with the desired pressure value relating to the non-working chamber.

21. The method of claim 20, wherein said controlling a flow condition of the working chamber includes, when a sensed pressure condition of the working chamber is smaller than the desired working pressure by a first predetermined working value, increasing fluid flow to the working chamber.

22. The method of claim 21, wherein said controlling a flow condition of the working chamber includes, when a sensed pressure condition of the working chamber is smaller than the desired working pressure by a first predetermined working value, zeroing a bleed flow from the working chamber.

23. The method of claim 21, wherein said controlling a flow condition of the non-working chamber includes, when a sensed pressure condition of the non-working chamber is smaller than the desired pressure of the non-working chamber by a first predetermined non-working value, decreasing fluid flow from the non-working chamber.

24. The method of claim 21, wherein said controlling a flow condition of the non-working chamber includes, when a sensed pressure condition of the non-working chamber is greater than the desired pressure of the non-working chamber by a second predetermined non-working value, increasing fluid flow from the non-working chamber.

25. The method of claim 16, wherein said controlling a flow condition of the working chamber includes, when a sensed pressure condition of the working chamber is greater than the desired working pressure by a second predetermined working value, decreasing fluid flow to the working chamber.

26. The method of claim 25, wherein said controlling a flow condition of the working chamber includes, when a sensed pressure condition of the working chamber is greater than the desired working pressure by a second predetermined working value, increasing a bleed flow from the working chamber.

27. The method of claim 25, wherein said controlling a flow condition of the non-working chamber includes, when a sensed pressure condition of the non-working chamber is smaller than the desired pressure of the non-working chamber by a first predetermined non-working value, decreasing fluid flow from the non-working chamber.

28. The method of claim 25, wherein said controlling a flow condition of the non-working chamber includes, when a sensed pressure condition of the non-working chamber is greater than the desired pressure of the non-working chamber by a second predetermined non-working value, increasing fluid flow from the non-working chamber.

* * * * *